US011905803B2

(12) United States Patent
Brown et al.

(10) Patent No.: US 11,905,803 B2
(45) Date of Patent: Feb. 20, 2024

(54) DUAL WELL, DUAL PUMP PRODUCTION

(71) Applicant: Halliburton Energy Services, Inc., Houston, TX (US)

(72) Inventors: Donn J. Brown, Houston, TX (US); Trevor A. Kopecky, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 40 days.

(21) Appl. No.: 17/194,005

(22) Filed: Mar. 5, 2021

(65) Prior Publication Data

US 2022/0282603 A1 Sep. 8, 2022

(51) Int. Cl.

| | |
|---|---|
| ***E21B 43/40*** | (2006.01) |
| ***E21B 43/14*** | (2006.01) |
| ***E21B 43/12*** | (2006.01) |
| ***E21B 43/26*** | (2006.01) |
| ***E21B 41/00*** | (2006.01) |
| ***E21B 43/30*** | (2006.01) |
| *E21B 33/12* | (2006.01) |

(52) U.S. Cl.

CPC ..... *E21B 43/14* (2013.01); *E21B 41/0042* (2013.01); *E21B 43/126* (2013.01); *E21B 43/128* (2013.01); *E21B 43/26* (2013.01); *E21B 43/305* (2013.01); *E21B 43/40* (2013.01); *E21B 33/12* (2013.01)

(58) Field of Classification Search

CPC .. E21B 43/26; E21B 43/2605; E21B 43/2607; E21B 43/27; E21B 41/0042; E21B 43/305; E21B 43/40; E21B 43/35

See application file for complete search history.

(56) References Cited

U.S. PATENT DOCUMENTS

| | | | | |
|---|---|---|---|---|
| 4,878,539 | A * | 11/1989 | Anders | E21B 43/121 166/372 |
| 5,123,488 | A | 6/1992 | Jennings | |
| 5,289,881 | A * | 3/1994 | Schuh | E21B 43/122 166/50 |
| 8,701,770 | B2 * | 4/2014 | Schultz | E21B 41/0042 166/50 |
| 2012/0085537 | A1 | 4/2012 | Banerjee et al. | |
| 2019/0153833 | A1 | 5/2019 | Coskuner | |
| 2020/0248541 | A1 | 8/2020 | Rabba et al. | |

FOREIGN PATENT DOCUMENTS

| | | | |
|---|---|---|---|
| CN | 102803648 | A | 11/2012 |
| WO | 2006-059057 | A1 | 6/2006 |

OTHER PUBLICATIONS

International Search Report and Written Opinion dated Dec. 1, 2021; International PCT Application No. PCT/US2021/022295.

* cited by examiner

*Primary Examiner* — Catherine Loikith

(74) *Attorney, Agent, or Firm* — Barnes & Thornburg, LLP

(57) ABSTRACT

Methods and systems for producing hydrocarbons. An example method includes producing a non-hydrocarbon liquid from a first horizontal wellbore, the first horizontal wellbore extending from a vertical wellbore and through a hydrocarbon producing formation. The method further includes pumping the non-hydrocarbon liquid with a first pump into a second horizontal wellbore, the second horizontal wellbore extending from the vertical wellbore and disposed downhole and underneath the first horizontal wellbore. The method additionally includes pumping a hydrocarbon liquid uphole to a surface with a second pump disposed downhole of the first horizontal wellbore.

10 Claims, 2 Drawing Sheets

FIG. 2

DUAL WELL, DUAL PUMP PRODUCTION

TECHNICAL FIELD

The present disclosure relates generally to production operations, and more particularly, to the use of a dual well, dual pump system to pressurize a producing formation while also providing a natural sump for liquids in order to reduce the blockage of gas flow to the surface.

BACKGROUND

Production may diminish in a producing well over the life of the well. As formation pressure decreases, the volume of fluid released from the formation may also decrease. In some instances, the producing formation has not run dry, but simply cannot maintain sufficient pressure to continue hydrocarbon output.

During production, a producing well may use a pump to lift a production fluid. During production, gas may travel with the liquid components of the production fluid as bubbles dispersed therein, or the gas may travel through the wellbore as a gas slug. For example, deviated or horizontal wells may have gas pockets that form in high spots or rises in the casing. These gas pockets may be flushed by pressure or liquid traveling downstream and they may be forced into upstream pumps. When a gas enters the pump it can impede the performance of the pump which may be detrimental to wellbore operations.

Provided are improvements to production operations through the use of a dual well, dual pump system that pressurizes a producing formation to maintain sufficient formation pressure and which also provides a natural sump for liquids in order to reduce the blockage of gas flow to the surface.

BRIEF DESCRIPTION OF THE DRAWINGS

Illustrative examples of the present disclosure are described in detail below with reference to the attached drawing figures, which are incorporated by reference herein, and wherein.

Figure 1:
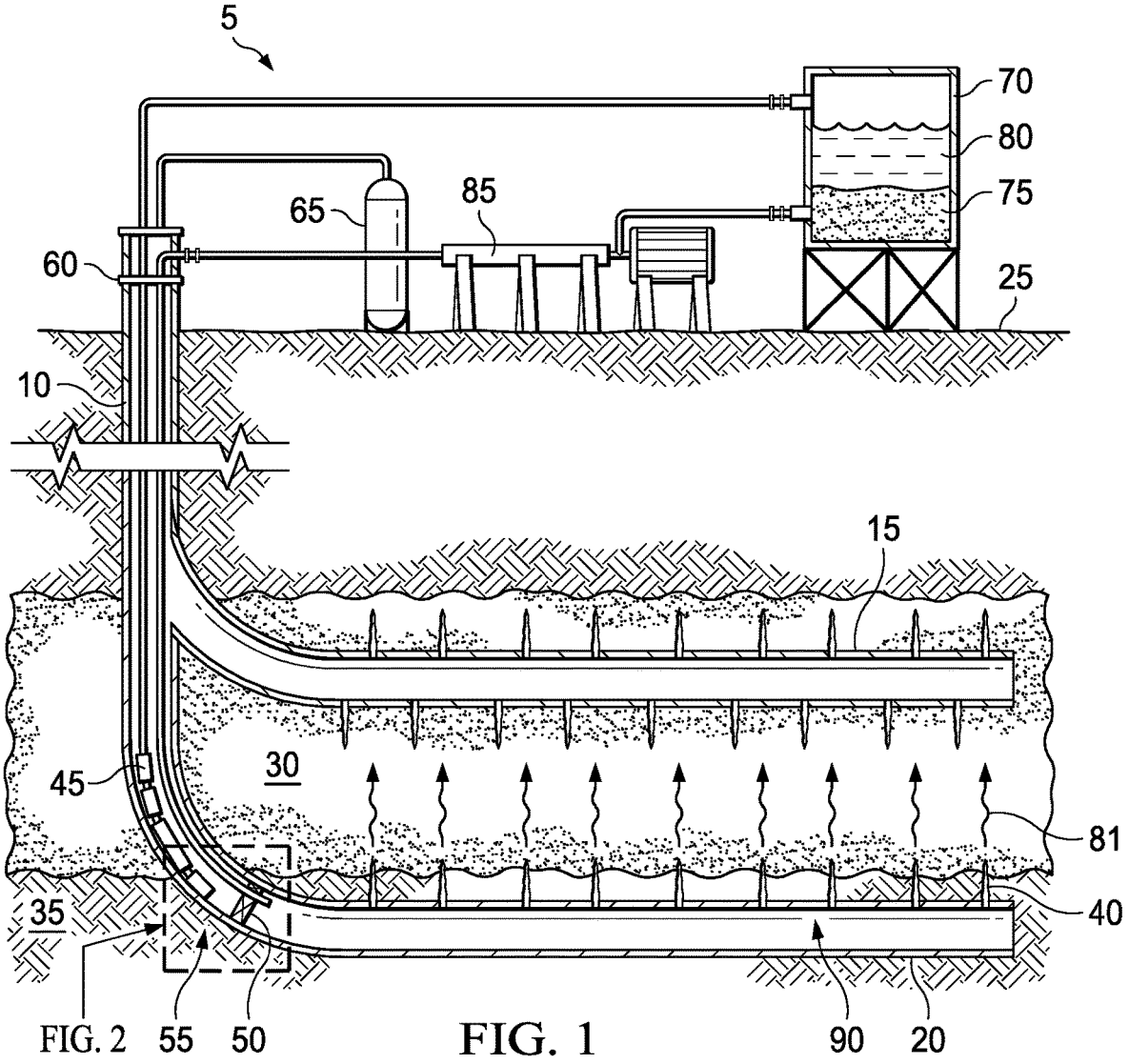
FIG. 1 is a cross-sectional illustration of an example dual well, dual pump system in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to production operations, and more particularly, to the use of a dual well, dual pump system to pressurize a producing formation while also providing a natural sump for non-hydrocarbon liquids in order to reduce the blockage of gas flow to the surface.

In the following detailed description of several illustrative examples, reference is made to the accompanying drawings that form a part hereof, and in which is shown by way of illustration, examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples is defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present disclosure. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

The terms vertical and horizontal may be used to refer to the orientation of a wellbore relative to the surface. For example, a vertical wellbore is wellbore descending down into the earth from the surface in a generally, but not strictly, vertical direction. Similarly, a horizontal wellbore is a wellbore that is drilled off a vertical wellbore beneath the surface and which extends in a generally horizontal direction relative to the surface.

As used herein, the term "formation" encompasses the term "reservoir," referring to a portion of the formation which has sufficient porosity and permeability to store or transmit fluids (e.g., hydrocarbons). As used herein, the term "fracturing fluid" refers generally to any fluid that may be used in a subterranean application in conjunction with a desired function and/or for a desired purpose. The term "fracturing fluid" does not imply any particular action by the fluid or any component thereof.

The examples described herein relate to the use of a dual well, dual pump system to pressurize a producing formation while also providing a natural sump for liquids in order to reduce the blockage of gas flow to the surface. A hydrocarbon production zone may produce three fluids: gas, oil, and water. The three fluids may separate due to their respective specific gravities with gas in the upper, oil in the middle, and water in the lower region of the produced fluids. The dual well, dual pump system utilizes two horizontal wellbores in communication with a vertical wellbore. The two horizontal wellbores are positioned such that one is uphole of and also extending above the other. The upper horizontal wellbore is the producing wellbore and is drilled through a producing formation. The lower wellbore is positioned below the upper wellbore and may be drilled through the bottom of, or just below the producing formation. The dual well, dual pump system further utilizes two pumps. One pump pumps the production fluid to the surface. The second pump pumps the non-hydrocarbon portion of the production fluid into the lower wellbore to establish a pressurization zone which increases formation pressure in the upper wellbore. Advantageously, the injected non-hydrocarbon fluids may reduce diminishing output of the producing formation over the life of the well. As a further advantage, the injection of the non-hydrocarbon fluids back into the formation may reduce disposal costs as there is no need to dispose of these fluids on the surface. Additionally, one of the pumps is disposed in the wellbore in a position to create a natural sump for the removal of liquid from the upper wellbore. As the liquid portions of the production fluid flow into the sump to be pumped uphole, the gas portion may separate and rise to the surface, thereby potentially reducing blockage of the gas flow. An additional advantage is that the pumps may be provide in two configurations with one configuration comprising a wellbore pump and a surface pump, and the other configuration comprising two wellbore pumps.

FIG. 1 illustrates a cross-sectional schematic of an example dual well, dual pump system 5. The dual well, dual pump system 5 comprises a vertical wellbore 10, a production wellbore 15, and an injection wellbore 20. The vertical wellbore 10 descends from the surface 25 through the various subterranean formations in a generally vertical direction. A production wellbore 15 has been drilled off the vertical wellbore 10 and extends generally horizontally through the production zone 30 of a producing formation. The injection wellbore 20 has been drilled below and underneath the production wellbore 15 and extends generally horizontally through either the bottom of the production zone 30 or through an adjacent formation 35 underneath the production zone 30. Perforations 40 have been formed in the injection wellbore 20 such that the perforations 40 provide a flow path into the production zone 30.

The dual well, dual pump system 5 further comprises two pumps. A production pump 45 is disposed downhole in the heel of the injection well 20. The production pump 45 is disposed downhole of the entry of the borehole for the production wellbore 15. The production pump 45 pumps a produced fluid from the production zone 30 via the production wellbore 15 to the surface 25. Downhole of the production pump 45 is a pressure packer 50. The pressure packer 50 isolates the injection well 20 allowing pressurization within injection well 20 to occur. The pressure packer 50 also provides a downhole barrier for the formation of a sump 55, with the pressure packer 50 being generally uphole of, and defining the pressurization zone 90 of the injection wellbore 20. The sump 55 serves as a reservoir for where the liquid portion of the produced fluid may accumulate, and due to the presence of the pressure packer 50, the liquid portion pools uphole of the pressure packer 50 and is sealed from further descent into the injection wellbore 20. As fluid is produced from the production wellbore 15 and driven into the vertical wellbore 10, at least a portion of the produced hydrocarbon and non-hydrocarbon liquids sink downhole to the sump 55. Consequently, the gaseous portion of the produced fluid may rise to the surface 25 with reduced impediment from the descending liquid portion. This fluid separation may result in easing gas flow to the surface 25 and consequently mitigate potential issues with gas slugs, etc. At the sump 55, the production pump 45 pumps the liquid portion of the produced fluid to the surface 25 by creating a pressure differential which assists in pulling the liquid components into the production pump 45 so that they are lifted upstream to the surface 25.

At the surface 25, the produced fluid is removed from the vertical wellbore 10 via the wellhead 60. The gaseous components are separated into a gas storage vessel 65. The liquid components are stored in a liquid storage vessel 70. In the liquid storage vessel 70, the liquid components may separate due to their specific gravities, such that the non-hydrocarbon liquids 75 may sink to the lower portion of the liquid storage vessel 70 and the hydrocarbon liquids 80 may rise to the upper portion of the liquid storage vessel 70. This liquid separation allows the lower portion of the liquid storage vessel 70 to be drained of the non-hydrocarbon liquids 75 while the hydrocarbon liquids 80 may continue to be stored inside the liquid storage vessels 70 for later processing.

An injection pump 85 is the second pump of the dual well, dual pump system 5. The injection pump 85 is disposed on the surface 25 and removes the non-hydrocarbon liquid 75 from the liquid storage vessel 70 and pumps the non-hydrocarbon liquid 75 into the vertical wellbore 10 and downhole past all of the production wellbore 15, the production pump 45, and the sump 55. The non-hydrocarbon liquid 75 is then pumped through a port in the pressure packer 50 to the pressurization zone 90 of the injection wellbore 20. Once within the pressurization zone 90 of the injection wellbore 20, the non-hydrocarbon liquid 75 may be pressurized within the enclosed space until it is forced to exit the pressurization zone 90 of the injection wellbore 20 via perforations 40 as illustrated by flow path arrows 81. The non-hydrocarbon liquids 75 may enter the production zone 30 and then pressurize the production zone 30 to force the formation fluids into the production wellbore 15 so that they may be produced by being driven into the vertical wellbore 10. The forcing of the non-hydrocarbon liquids 75 into the production wellbore 15 via the underlying injection wellbore 20 may prolong the producing life of the reservoir surrounding the production wellbore 15 by maintaining adequate formation pressure in the production zone 30. Further, operational expenditures may be reduced as there is no need to dispose of the produced non-hydrocarbon liquid 75 on the surface 25 as the non-hydrocarbon liquids 75 may be continuously reinjected throughout the operation.

Figure 2:
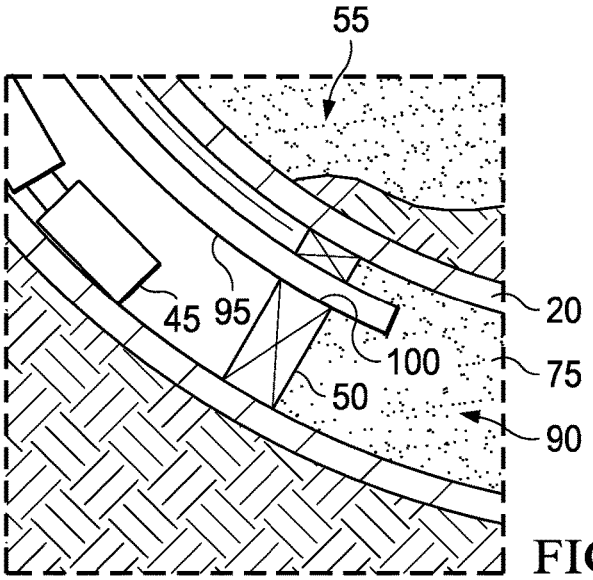
FIG. 2 is cross-sectional illustration of the sump formed above a pressure packer along view AA of FIG. 1 in accordance with one or more examples described herein.

FIG. 2 illustrates a cross-sectional schematic of the sump 55 as enlarged and illustrated from view AA of FIG. 1. Downhole of the production pump 45 is the pressure packer 50. As discussed above, the injection pump 85 on the surface 25 (as illustrated in FIG. 1) pumps the non-hydrocarbon liquids 75 past the production pump 45 and the sump 55. The non-hydrocarbon liquids are then emptied into the pressurization zone 90 of the injection wellbore 20. The non-hydrocarbon liquids 75 are conveyed into the pressurization zone 90 via a discharge conduit 95 that extends from the injection pump 85 on the surface 25 and runs downhole through the vertical wellbore 10 and through the pressure packer 50. The discharge conduit 95 extends through the pressure packer 50 via a port 100 within the pressure packer 50. The port 100 of the pressure packer 50 is sealed around the discharge conduit 95 such that the pressurization zone 90 of the injection wellbore 20 is isolated from the sump 55 upstream of the pressure packer 50. As the discharge conduit 95 empties the non-hydrocarbon liquids 75 into the pressurization zone 90 of the vertical wellbore 20, fluid pressure may continue to build as more and more of the non-hydrocarbon liquids 75 are injected. As discussed above, the pressurization zone 90 is a mostly enclosed space surrounded by the adjacent formation 35, which may have limited permeability, or by the production zone 30 itself. The easiest path of escape from the pressurization zone 90 is thus limited to the perforations 40 as illustrated in FIG. 1 and discussed above.

Although only a single production wellbore 15 and an injection wellbore 20 are illustrated, it is to be understood that multiples production wellbores 15 and injection wellbores 20 may be drilled off of the vertical wellbore 10 in all examples. It is to be understood that the dual well, dual pump system 5 and its components as depicted in FIGS. 1-2 are only one possible configuration of a dual well, dual pump system 5. The individual pieces of the dual well, dual pump system 5 may be rearranged as would be readily apparent to one of ordinary skill in the art. As such, it is to be recognized that the dual well, dual pump system 5 is merely exemplary in nature, and various additional configurations may be used that have not necessarily been depicted in FIGS. 1-2 in the interest of clarity. Moreover, non-limiting additional components may be present, including, but not limited to, valves, condensers, adapters, joints, gauges, sensors, compressors, pressure controllers, pressure sensors, flow rate controllers, flow rate sensors, temperature sensors, and the like. As such, it should be clearly understood that the example illustrated by FIGS. 1-2 is merely a general application of the principles of this disclosure in practice, and a wide variety of other examples are possible. Therefore, the scope of this disclosure is not limited in any manner to the details of FIGS. 1-2 as described herein.

Figure 3:
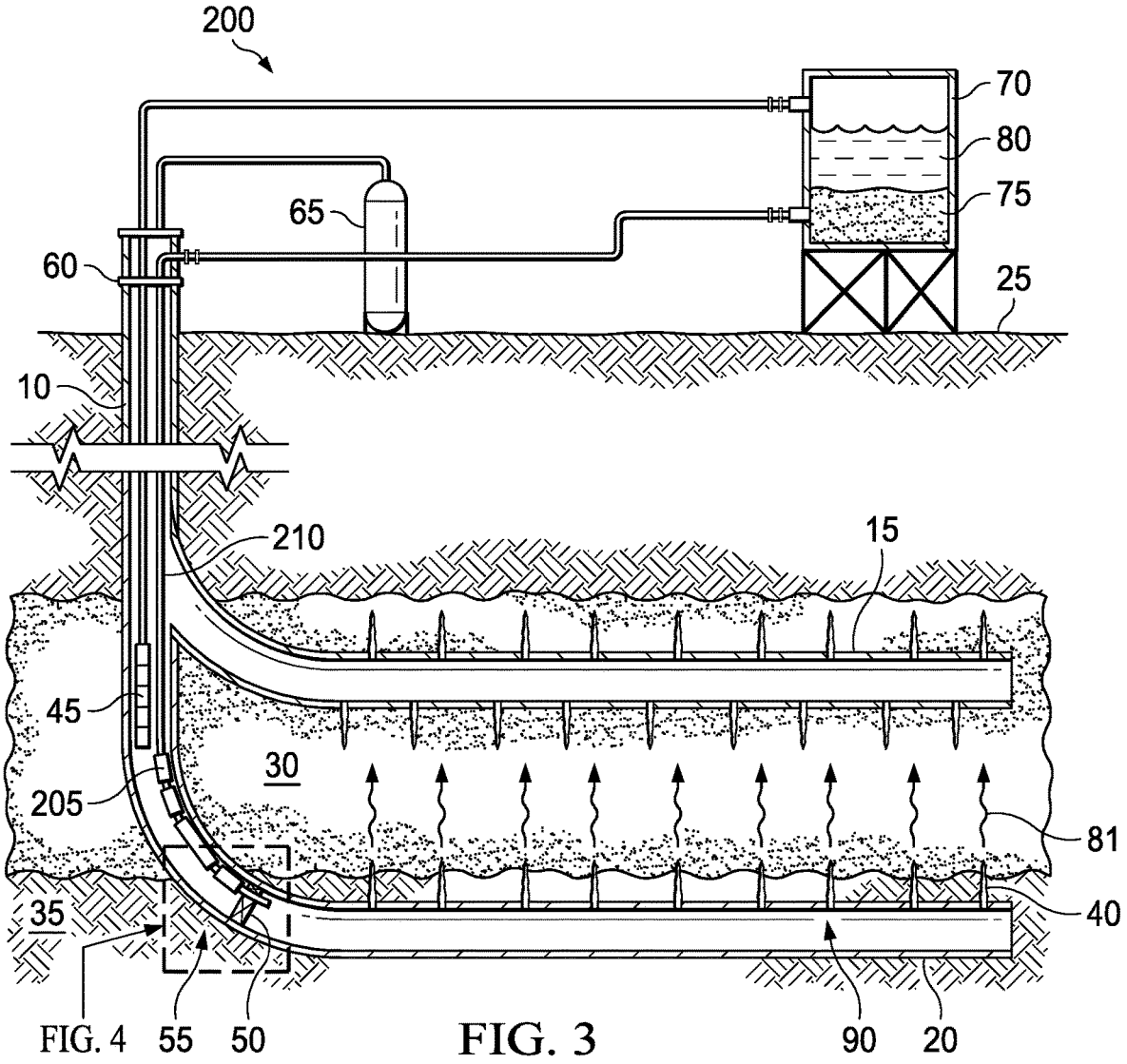
FIG. 3 is a cross-sectional illustration of another example dual well, dual pump system in accordance with one or more examples described herein.

FIG. 3 illustrates a cross-sectional schematic of an example dual well, dual pump system 200. The dual well, dual pump system 200 comprises many of the same components of the dual well, dual pump system 5 illustrated in FIGS. 1-2 and identical reference markers are used to identify identical components. The dual well, dual pump system 200 comprises a vertical wellbore 10, a production wellbore 15, and an injection wellbore 20. The vertical wellbore 10 descends from the surface 25 through the various subterranean formations in a generally vertical direction. A production wellbore 15 has been drilled off the vertical wellbore 10 and extends generally horizontally through the production zone 30 of a producing formation. The injection wellbore 20 has been drilled below and underneath the production wellbore 15 and extends generally horizontally through either the bottom of the production zone 30 or through an adjacent formation 35 underneath the production zone 30. Perforations 40 have been formed in the injection wellbore 20 such that the perforations 40 provide a flow path into the production zone 30.

The dual well, dual pump system 200 further comprises two pumps. A production pump 45 is disposed downhole in the heel of the injection well 20. The production pump 45 is disposed downhole of the entry of the borehole for the production wellbore 15. The production pump 45 pumps a produced fluid from the production zone 30 via the production wellbore 15 to the surface 25. In order to accommodate the injection pump 205 placed downhole, in some examples, the production pump 45 may be disposed uphole of its location illustrated in FIG. 1. If the production pump 45 is placed uphole relative to its position in FIG. 1, it will still remain downhole of the entry to the borehole of the production well 15. Downhole of the production pump 45 is an injection pump 205 and a pressure packer 50. The pressure packer 50 isolates the injection well 20 allowing pressurization within injection well 20 to occur. The pressure packer 50 also provides a downhole barrier for the formation of a sump 55, with the pressure packer 50 being generally uphole of, and defining the pressurization zone 90 of the injection wellbore 20. The sump 55 serves as a reservoir for where the liquid portion of the produced fluid may accumulate, and due to the presence of the pressure packer 50, the liquid portion pools uphole of the pressure packer 50 and is sealed from further descent into the injection wellbore 20. As fluid is produced from the production wellbore 15 and driven into the vertical wellbore 10, at least a portion of the produced hydrocarbon and non-hydrocarbon liquids sink downhole towards the sump 55. Consequently, the gaseous portion of the produced fluid may rise to the surface 25 with reduced impediment from the descending liquid portion. This fluid separation may result in easing gas flow to the surface 25 and consequently mitigate potential issues with gas slugs, etc. As the non-hydrocarbon liquids and the hydrocarbon liquids descend towards the sump 55, the production pump 45 pumps at least a portion of these liquids toward the surface 25 by creating a pressure differential which assists in pulling the liquid components into the production pump 45 so that they are lifted upstream to the surface 25. The production pump 45 pumps the produced fluid towards the surface 25.

At the surface 25, the produced fluid is removed from the vertical wellbore 10 via the wellhead 60. The gaseous components are separated into a gas storage vessel 65. The liquid components are stored in a liquid storage vessel 70. In the liquid storage vessel 70, the liquid components may separate due to their specific gravities, such that the non-hydrocarbon liquids 75 may sink to the lower portion of the liquid storage vessel 70 and the hydrocarbon liquids 80 may rise to the upper portion of the liquid storage vessel 70. This liquid separation allows the lower portion of the liquid storage vessel 70 to be drained of the non-hydrocarbon liquids 75 while the hydrocarbon liquids 80 may continue to be stored inside the liquid storage vessels 70 for later processing.

Figure 4:
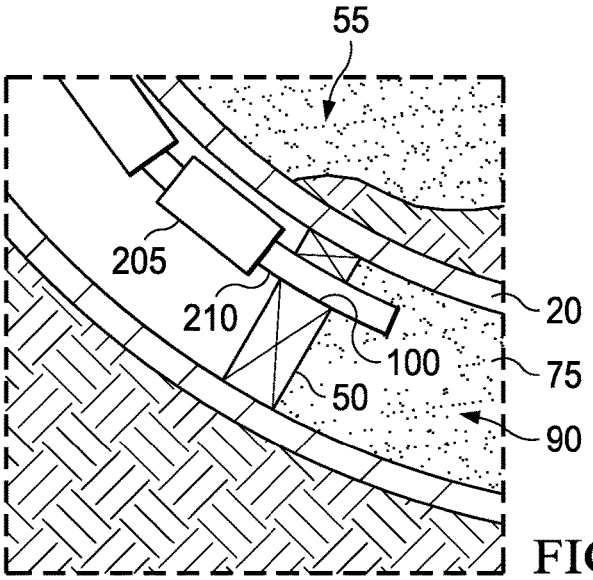
FIG. 4 is cross-sectional illustration of the sump formed above a pressure packer along view AA of FIG. 3 in accordance with one or more examples described herein.

A downhole injection pump 205 is the second pump of the dual well, dual pump system 200. The injection pump 205 is disposed downhole proximate to the pressure packer 50. In the illustrated example of FIG. 3, the injection pump 205 is uphole of the pressure packer 50. In an alternative example, the injection pump 205 may be disposed downhole of the pressure packer 50 within the pressurization zone 90. The non-hydrocarbon liquid 75 flows downhole via discharge conduit 210 to the injection pump 205, which pumps the non-hydrocarbon liquid 75 through a port in the pressure packer 50 to the pressurization zone 90 of the injection wellbore 20. Downhole flow via discharge conduit 210 is accomplished by gravity, as the non-hydrocarbon liquid 75 naturally flows downhole in the vertical wellbore 10, past the production wellbore 15 and to the injection pump 205. In an optional alternative example, a third pump on the surface 25 may be used to pump the non-hydrocarbon liquid 75 downhole to the injection pump 210 should gravitational flow be insufficient for flowing the non-hydrocarbon liquid 75. The primary difference between the example illustrated in FIGS. 1 and 2, and the example illustrated in FIGS. 3 and 4 is the location of the injection pump. In FIGS. 1 and 2, injection pump 85 is located on the surface 25. In FIGS. 3 and 4, injection pump 205 is located downhole proximate to the pressure packer 50. In both examples, the non-hydrocarbon liquid 75 is separated from the hydrocarbon liquid 80 in a liquid storage vessel 70 on the surface 25 and then subsequently injected into the injection wellbore 20.

Once within the pressurization zone 90 of the injection wellbore 20, the non-hydrocarbon liquid 75 may be pressurized within the enclosed space until it is forced to exit the pressurization zone 90 of the injection wellbore 20 via perforations 40 as illustrated by flow path arrows 81. The non-hydrocarbon liquids 75 may enter the production zone 30 and then pressurize the production zone 30 to force the formation fluids into the production wellbore 15 so that they may be produced by being driven into the vertical wellbore 10. The forcing of the non-hydrocarbon liquids 75 into the production wellbore 15 via the underlying injection wellbore 20 may prolong the producing life of the reservoir surrounding the production wellbore 15 by maintaining adequate formation pressure in the production zone 35. Further, operational expenditures may be reduced as the volume of non-hydrocarbon liquid 75 produced is returned to production zone 30.

FIG. 4 illustrates a cross-sectional schematic of the sump 55 as enlarged and illustrated from view AA of FIG. 4. Downhole of the injection pump 205 is the pressure packer 50. As discussed above, the injection pump 205 pumps the non-hydrocarbon liquids 75 past the pressure packer 55 and empties them into the pressurization zone 90 of the injection wellbore 20. The non-hydrocarbon liquids 75 are conveyed into the pressurization zone 90 via the discharge conduit 210 that extends from the liquid storage vessel 70 on the surface 25 to the injection pump 205, where it then further extends through the pressure packer 50. The discharge conduit 210 extends through the pressure packer 50 via a port 100 within the pressure packer 50. The port 100 of the pressure packer 50 is sealed around the discharge conduit 210 such that the pressurization zone 90 of the injection wellbore 20 is isolated from the sump 55 upstream of the pressure packer 50. As the discharge conduit 210 empties the non-hydrocarbon liquids 75 into the pressurization zone 90 of the vertical wellbore 20, fluid pressure may continue to build as more and more of the non-hydrocarbon liquids 75 are injected. As discussed above, the pressurization zone 90 is a mostly enclosed space surrounded by the adjacent formation 35, which may have limited permeability, or by the production zone 30 itself. The easiest path of escape from the pressurization zone 90 is thus limited to the perforations 40 as illustrated in FIG. 3 and discussed above.

In an alternative configuration, the injection pump 205 may be located downhole of the pressure packer 50 within the pressurization zone 90 of the injection wellbore 20. In this configuration, the discharge conduit 210 extends from the liquid storage vessel 70 on the surface 25 and continues downhole in the vertical wellbore 10 through the port 100 of the pressure packer 50 to be coupled to the injection pump 205 located within the pressurization zone 90. Optionally, a third pump (e.g., an additional injection pump that is analogous to injection pump 85 in FIG. 1) may be used to pump the non-hydrocarbon liquids 75 from the liquid storage vessel 70 to the injection pump 205 located within the pressurization zone 90 should gravitational flow from the surface 25 be insufficient for flowing the non-hydrocarbon liquids 75 to the injection pump 205.

Although only a single production wellbore 15 and an injection wellbore 20 are illustrated, it is to be understood that multiples production wellbores 15 and injection wellbores 20 may be drilled off of the vertical wellbore 10 in all examples.

It is to be understood that the dual well, dual pump system 200 and its components as depicted in FIGS. 3-4 are only one possible configuration of a dual well, dual pump system 200. The individual pieces of the dual well, dual pump system 200 may be rearranged as would be readily apparent to one of ordinary skill in the art. As such, it is to be recognized that the dual well, dual pump system 200 is merely exemplary in nature, and various additional configurations may be used that have not necessarily been depicted in FIGS. 3-4 in the interest of clarity. Moreover, non-limiting additional components may be present, including, but not limited to, valves, condensers, adapters, joints, gauges, sensors, compressors, pressure controllers, pressure sensors, flow rate controllers, flow rate sensors, temperature sensors, and the like. As such, it should be clearly understood that the example illustrated by FIGS. 3-4 is merely a general application of the principles of this disclosure in practice, and a wide variety of other examples are possible. Therefore, the scope of this disclosure is not limited in any manner to the details of FIGS. 3-4 as described herein.

It is to be recognized that the example dual well, dual pump systems described herein may also directly or indirectly affect the various downhole equipment and tools that may contact the dual well, dual pump systems disclosed herein. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, packers, and the like. Any of these components may be included in the apparatus, methods, and systems generally described above and depicted in FIGS. 1-4.

In some examples, the production pump comprises any suitable production pump, including, but not limited to, electric submersible pumps, rod pumps, progressive cavity pumps, and the like.

In examples where the injection pump is disposed downhole, the injection pump may comprise any suitable injection pump including, but not limited to, electric submersible pumps, rod pumps, progressive cavity pumps, and the like.

In examples where the injection pump is disposed on the surface, the injection pump may comprise any suitable surface injection pump including but not limited to, horizontal pumping systems, centrifugal pumps, and the like.

Provided are methods for producing hydrocarbons. An example method comprises producing a non-hydrocarbon liquid from a first horizontal wellbore, the first horizontal wellbore extending from a vertical wellbore and through a hydrocarbon producing formation. The method further comprises pumping the non-hydrocarbon liquid with a first pump into a second horizontal wellbore, the second horizontal wellbore extending from the vertical wellbore and disposed downhole and underneath the first horizontal wellbore. The method additionally comprises pumping a hydrocarbon liquid uphole to a surface with a second pump disposed downhole of the first horizontal wellbore.

Additionally or alternatively, the method may include one or more of the following features individually or in combination. The first pump may be disposed on the surface and be fluidically coupled to the second horizontal wellbore with a discharge conduit. The discharge conduit may traverse a pressure packer which isolates the second horizontal wellbore from the vertical wellbore. The first pump may be disposed downhole of the second pump and be fluidically coupled to the second horizontal wellbore with a discharge conduit. The discharge conduit may traverse a pressure packer which isolates the second horizontal wellbore from the vertical wellbore.

Provided is a system for producing hydrocarbons. An example system comprises a vertical wellbore descending from a surface and through a hydrocarbon producing formation; a first horizontal wellbore extending from the vertical wellbore and through the hydrocarbon producing formation; a second horizontal wellbore extending from the vertical wellbore and disposed downhole and underneath the first horizontal wellbore; a first pump disposed on the surface; a second pump disposed downhole of the first horizontal wellbore; and a pressure packer disposed downhole of the second pump, wherein the pressure packer isolates the second horizontal wellbore from the vertical wellbore.

Additionally or alternatively, the system include one or more of the following features individually or in combination. The second pump may be configured to pump fluids that collect uphole of the pressure packer to the surface. The system may be further configured to separate the fluids at the surface into hydrocarbon liquids and non-hydrocarbon liquids. The system may further comprise a liquid storage vessel in which the fluids are separated due to their differing specific gravities. The system may further comprise a discharge conduit descending from the first pump through the pressure packer. The non-hydrocarbon liquids may be discharged into the second horizontal wellbore via the discharge conduit. The second horizontal wellbore may be perforated such that the discharged non-hydrocarbon liquids flow through the perforations and into the hydrocarbon producing formation. The second pump may be an electric submersible pump, rod pump, or a progressive cavity pump.

Provided is another system for producing hydrocarbons. An example system comprises a vertical wellbore descending from a surface and through a hydrocarbon producing formation; a first horizontal wellbore extending from the vertical wellbore and through the hydrocarbon producing formation; a second horizontal wellbore extending from the vertical wellbore and disposed downhole and underneath the first horizontal wellbore; a first pump disposed downhole of the first horizontal wellbore; a second pump disposed downhole of the first pump; and a pressure packer disposed downhole of the second pump, wherein the pressure packer isolates the second horizontal wellbore from the vertical wellbore.

Additionally or alternatively, the system include one or more of the following features individually or in combination. The second pump may be configured to pump fluids that collect uphole of the pressure packer to the surface. The first pump may be configured to pump fluids produced from the first horizontal wellbore to the surface. The system may further comprise a discharge conduit descending from the second pump through the pressure packer. The non-hydrocarbon liquids may be discharged into the second horizontal wellbore via the discharge conduit. The second horizontal wellbore may be perforated such that the discharged non-hydrocarbon liquids flow through the perforations and into the hydrocarbon producing formation. The second pump may be an electric submersible pump, rod pump, or a progressive cavity pump.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of" or "consist of the various components and steps." Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A system for producing hydrocarbons comprising:

a vertical wellbore descending from a surface and through a hydrocarbon producing formation;

a first horizontal wellbore extending from the vertical wellbore and through the hydrocarbon producing formation;

a second horizontal wellbore extending from the vertical wellbore and disposed downhole and underneath the first horizontal wellbore;

a first pump disposed on the surface;

a second pump disposed downhole of the first horizontal wellbore; wherein the second pump is configured to pump produced fluids that collect uphole of a pressure packer to the surface; wherein the produced fluids collect above the pressure packer but below the first horizontal wellbore; wherein the second pump is an electric submersible pump, rod pump, or a progressive cavity pump; and the pressure packer disposed downhole of the second pump, wherein the pressure packer isolates the second horizontal wellbore from the vertical wellbore.

2. The system of claim 1, wherein the system is further configured to separate the fluids at the surface into hydrocarbon liquids and non-hydrocarbon liquids.

3. The system of claim 2, further comprising a liquid storage vessel in which the fluids are separated due to their differing specific gravities.

4. The system of claim 1, further comprising a discharge conduit descending from the first pump through the pressure packer.

5. The system of claim 4, wherein non-hydrocarbon liquids are discharged into the second horizontal wellbore via the discharge conduit.

6. The system of claim 5, wherein the second horizontal wellbore is perforated such that the discharged non-hydrocarbon liquids flow through the perforations and into the hydrocarbon producing formation.

7. The system of claim 1, wherein the first pump is a horizontal pumping system or a centrifugal pump.

8. A method for producing hydrocarbons comprising:

producing a fluid from a first horizontal wellbore with a first pump, the first horizontal wellbore extending from a vertical wellbore and through a hydrocarbon producing formation;

separating the fluid into a hydrocarbon and non-hydrocarbon liquid; and pumping the non-hydrocarbon liquid with a second pump into a second horizontal wellbore, the second horizontal wellbore extending from the vertical wellbore and disposed downhole and underneath the first horizontal wellbore; wherein the first pump is configured to pump produced fluids that collect uphole of a pressure packer to the surface; wherein the produced fluids collect above the pressure packer but below the first horizontal wellbore; wherein the first pump is an electric submersible pump, rod pump, or a progressive cavity pump.

9. The method of claim 8, wherein the second pump is disposed on the surface and is fluidically coupled to the second horizontal wellbore with a discharge conduit.

10. The method of claim 9, wherein the discharge conduit traverses the pressure packer which isolates the second horizontal wellbore from the vertical wellbore.

* * * * *